US006978509B2

(12) United States Patent
Lin

(10) Patent No.: US 6,978,509 B2
(45) Date of Patent: Dec. 27, 2005

(54) CLEANSING DEVICE HAVING CLEANSING FIBERS

(76) Inventor: Pai Yung Lin, P.O.Box 10-69, Chong Ho, Taipei (TW) 235

( * ) Notice: Subject to any disclaimer, the term of this patent is extended or adjusted under 35 U.S.C. 154(b) by 0 days.

(21) Appl. No.: 10/774,944

(22) Filed: Feb. 6, 2004

(65) Prior Publication Data

US 2005/0172440 A1 Aug. 11, 2005

(51) Int. Cl.[7] ..... A47L 13/12; A47L 13/20; A47L 13/38

(52) U.S. Cl. ..... 15/229.7; 15/209.1; 15/229.8; 15/247

(58) Field of Search ..... 15/229.1–229.4, 15/229.7, 229.8, 247, 114, 115, 209.1, 210.1, 15/145; 156/308.2, 308.4, 309.3, 309.6

(56) References Cited

U.S. PATENT DOCUMENTS

| | | | | |
|---|---|---|---|---|
| 823,725 | A * | 6/1906 | Hayden | 15/114 |
| 1,922,450 | A * | 8/1933 | O'Brien | 15/220.4 |
| 4,116,205 | A * | 9/1978 | Owen et al. | 132/313 |
| 4,144,612 | A | 3/1979 | Yamaguchi | 15/208 |
| 4,490,895 | A | 1/1985 | Lin | 28/143 |
| 6,813,801 | B2 * | 11/2004 | Tanaka et al. | 15/229.3 |
| 2004/0016074 | A1 * | 1/2004 | Tanaka | 15/228 |

* cited by examiner

*Primary Examiner*—John Kim
*Assistant Examiner*—Shay L. Balsis

(57) ABSTRACT

A cleansing device includes a cleansing cloth having a base and a cover fabric layers superposed together, and a number of fibers disposed and secured between the base and the cover fabric layers. A handle is attached to the cleansing cloth to carry and operate the cleansing cloth. Each of the fabric layers may include a number of strips to partially expose the fibers. An outer fabric layer may be attached to the cover fabric layer to form one or more pockets and to receive the handle. The handle includes a fork having two arms engageable into the pocket of the cleansing cloth, and a hand grip foldably secured to the fork.

1 Claim, 8 Drawing Sheets

CLEANSING DEVICE HAVING CLEANSING FIBERS

BACKGROUND OF THE INVENTION

1. Field of the Invention

The present invention relates to a cleansing device, and more particularly to a cleansing device having a number of fibers for cleansing purposes.

2. Description of the Prior Art

Various kinds of typical cleansing devices have been developed for cleaning and wiping purposes, and comprise a number of layers of woven or non-woven fabrics superposed or stacked together, and stitched together to form a cleansing and wiping cloth, and hemmed around the periphery to form an entity.

For example, U.S. Pat. No. 4,144,612 to Yamaguchi, and U.S. Pat. No. 4,490,895 to Lin disclose two of the typical cleansing devices each including a number of superposed or stacked layers of fabrics that are stitched together to form the cleansing and wiping cloth.

However, without any holding handle devices, the users have to hold the entire cleansing cloth, and thus may also be dirtied by the dirt. Similarly, while cleansing or wiping dirt, the cleansing cloth normally will be soaked in water, and the hands of the users will also be wetted by the water.

Furthermore, the layered fabrics of the cleansing cloth normally include common borders, and the portions surrounded by the common borders are stitched to form a closed and stitched periphery, which may not be suitably used for cleansing purposes.

The present invention has arisen to mitigate and/or obviate the afore-described disadvantages of the conventional cleansing devices.

SUMMARY OF THE INVENTION

The primary objective of the present invention is to provide a cleansing device including a number of fibers for cleansing purposes.

The other objective of the present invention is to provide a cleansing device including a handle for easily holding and carrying the cleansing device.

The further objective of the present invention is to provide a cleansing device including a handle that may be folded to compact folding or storing configuration.

In accordance with one aspect of the invention, there is provided a cleansing device comprising a cleansing cloth including a base fabric layer, a cover fabric layer disposed above the base fabric layer, and a plurality of fibers disposed between and secured between the base and the cover fabric layers, and a handle attached to the cleansing cloth to carry and operate the cleansing cloth.

The base fabric layer includes at least one side having a plurality of strips formed therein to partially expose the fibers. The cover fabric layer includes at least one side having a plurality of strips formed therein to partially expose the fibers.

An outer fabric layer may further be provided and attached onto the cover fabric layer, and secured to the cover fabric layer to form at least one pocket and to receive the handle. The cleansing cloth includes two welding portions provided on the outer and the cover fabric layers, to secure the outer and the cover fabric layers together, and to form the pocket in the cleansing cloth.

The cleansing cloth includes two second welding portions provided on the outer and the cover fabric layers, and arranged between the welding portions to separate the pocket into two pockets. The cleansing cloth includes a cut line partially formed between the second welding portions to allow the two pockets to be partially separated from each other. The cleansing cloth includes at least one fiber coupled between the two pockets, to breakably couple the two pockets together.

The cleansing cloth includes one end having a welding portion provided thereon, to form a closed end for the pocket. The cover fabric layer includes a length greater than that of the cover fabric layer to facilitate an engagement of the handle into the pocket of the cleansing cloth.

The handle includes a fork having two arms engageable into the pocket of the cleansing cloth. The handle includes at least one projection extended from each of the arms, for frictionally engaging with the cleansing cloth.

The handle includes a hand grip pivotally attached to the fork, to allow the hand grip to be rotated relative to the fork between an outwardly extending position and an inwardly folding position. A retaining device may further be provided for retaining the hand grip to the fork at the outwardly extending position. The retaining device includes at least one notch formed in the hand grip, and at least one catch extended from the fork and engageable into the notch of the hand grip.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
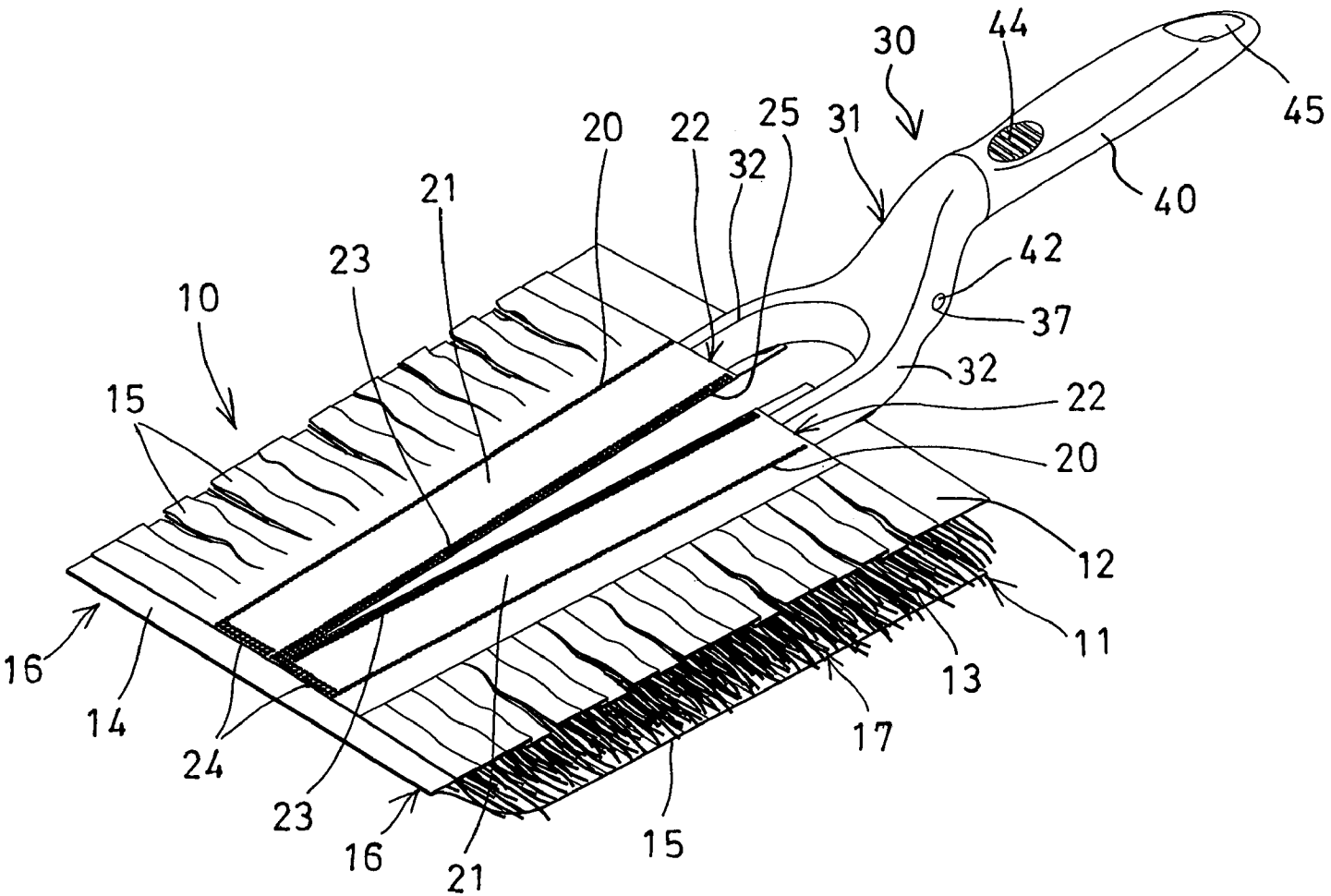
FIG. 1 is a perspective view of a cleansing device in accordance with the present invention.
Figure 2:
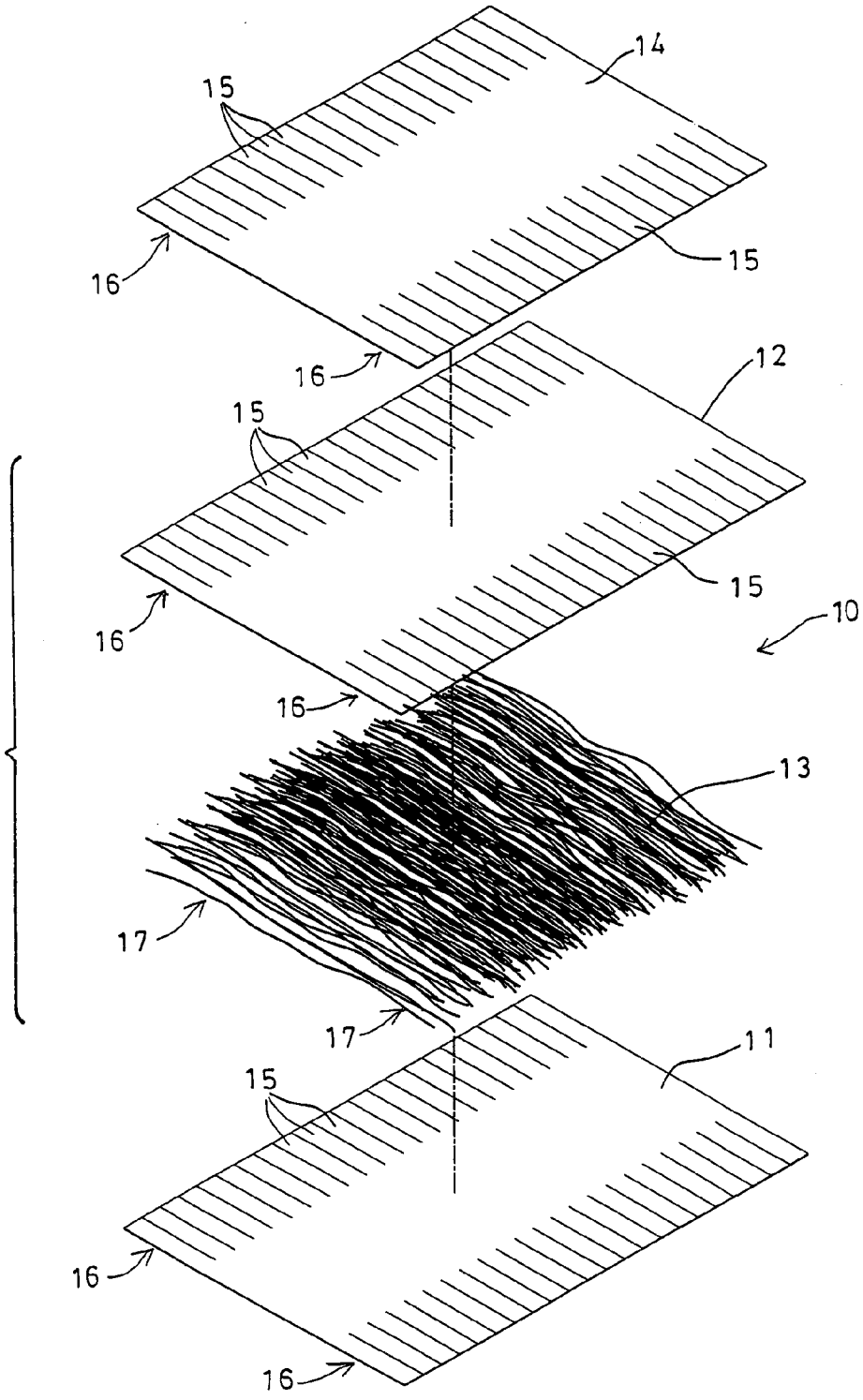
FIG. 2 is an exploded view of a cleansing cloth of the cleansing device.
Figure 4:
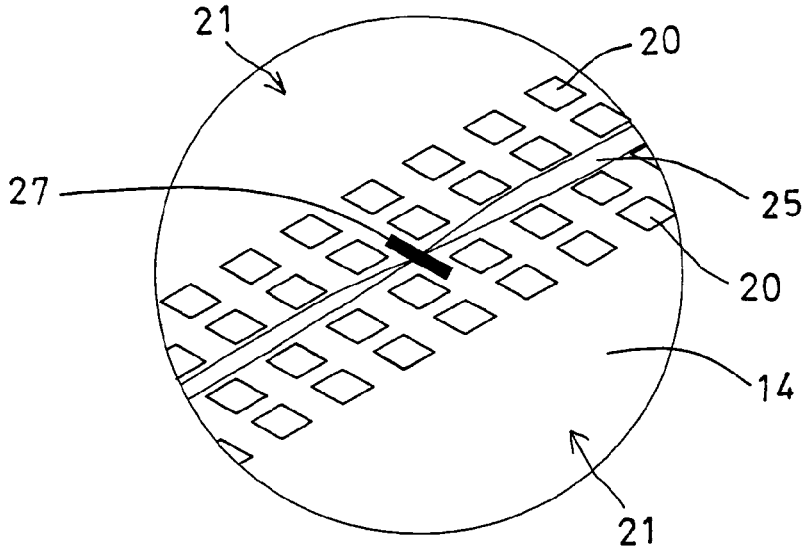
FIG. 4 is an enlarged partial perspective view of the cleansing cloth of the cleansing device.
Figure 6:
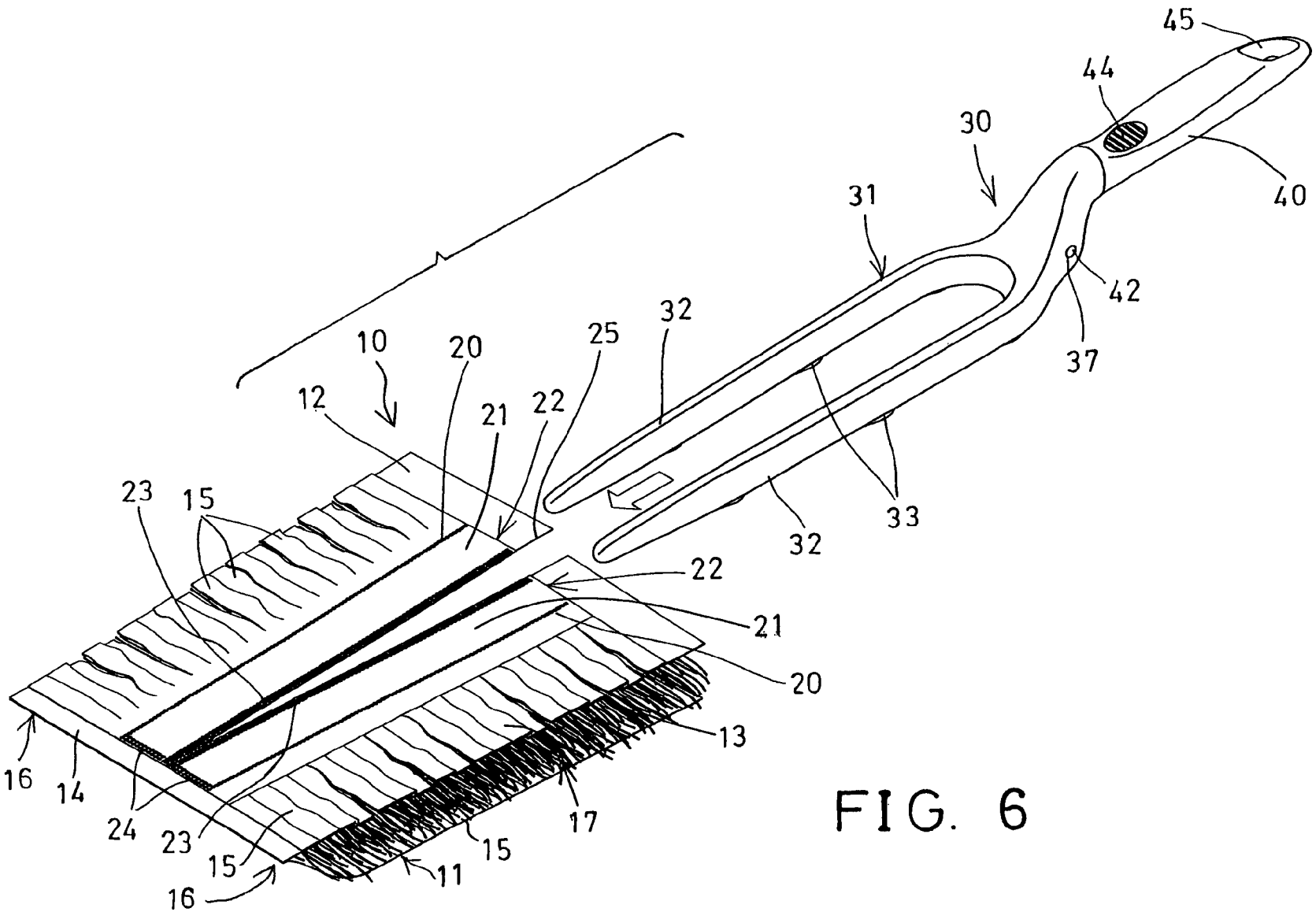
FIG. 6 is a partial exploded view illustrating the operation of the cleansing device.
Figure 7:
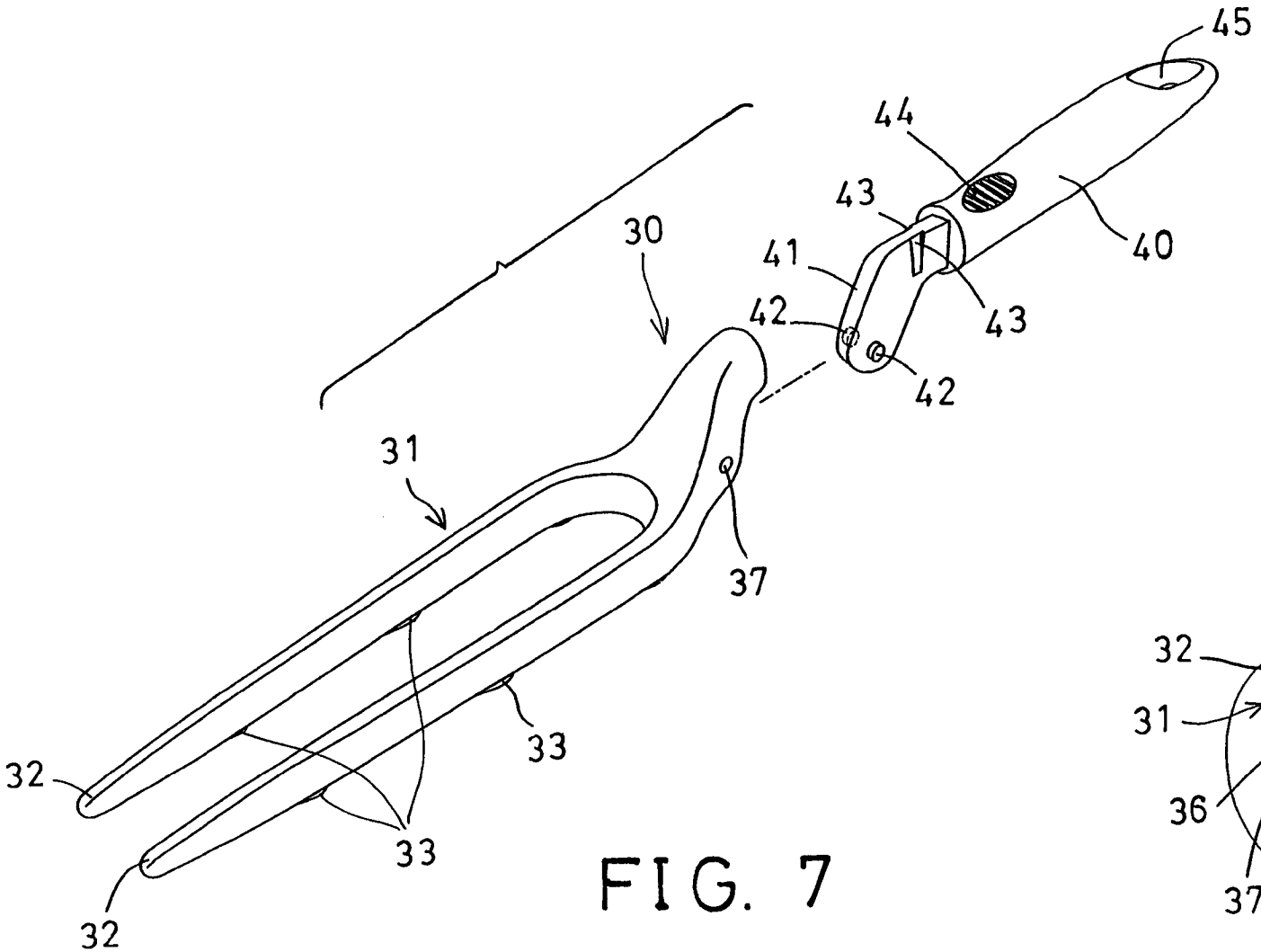
FIG. 7 is an exploded view of a handle of the cleansing device.

Referring to the drawings, and initially to FIGS. 1 and 6, a cleansing device in accordance with the present invention comprises a cleansing cloth 10, and a handle 30 to be selectively or detachably attached to the cloth 10 to hold and carry and operate the cleansing cloth 10.

Referring next to FIGS. 2–5, the cleansing cloth 10 includes a base fabric layer 11, a cover fabric layer 12 disposed above the base fabric layer 11, and a number of fibers 13 disposed between the base and the cover fabric layers 11, 12, and to be secured between the base and the cover fabric layers 11, 12 with adhesive materials, stitches or by welding processes, or by hot melting processes.

For example, one or more, such as two longitudinal and parallel welding lines or portions 20 are formed in the middle portions of the base and the cover fabric layers 11, 12, to secure the middle portions of the base and the cover fabric layers 11, 12 together, and to solidly secure the fibers 13 between the base and the cover fabric layers 11, 12.

An outer fabric layer 14 may further be provided and disposed above the cover fabric layer 12, and also to be secured to the base and the cover fabric layers 11, 12 with adhesive materials, stitches or by welding processes, or by hot melting processes. For example, the outer fabric layer 14 may also be secured to the base and the cover fabric layers 11, 12 with the two longitudinal and parallel welding lines or portions 20, to form one or more pockets 21 between the outer and the cover fabric layers 14, 12.

Figure 3:
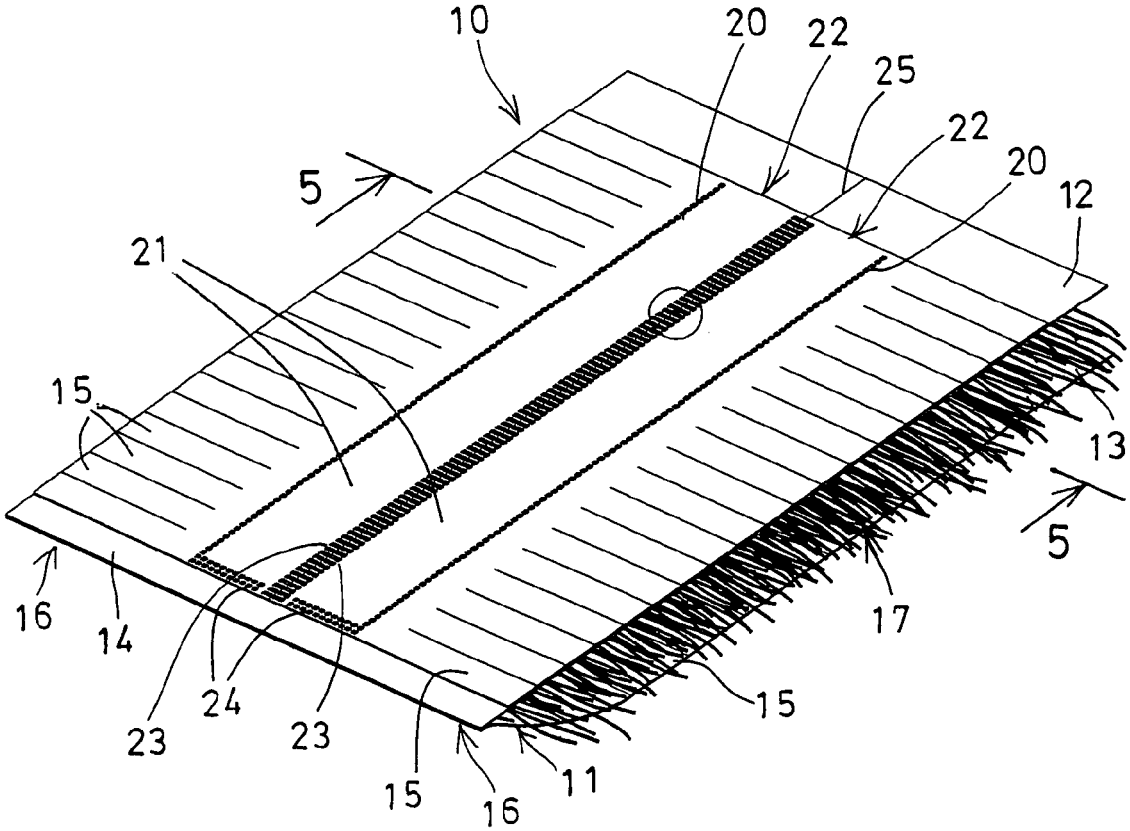
FIG. 3 is a perspective view of the cleansing cloth of the cleansing device.
Figure 5:
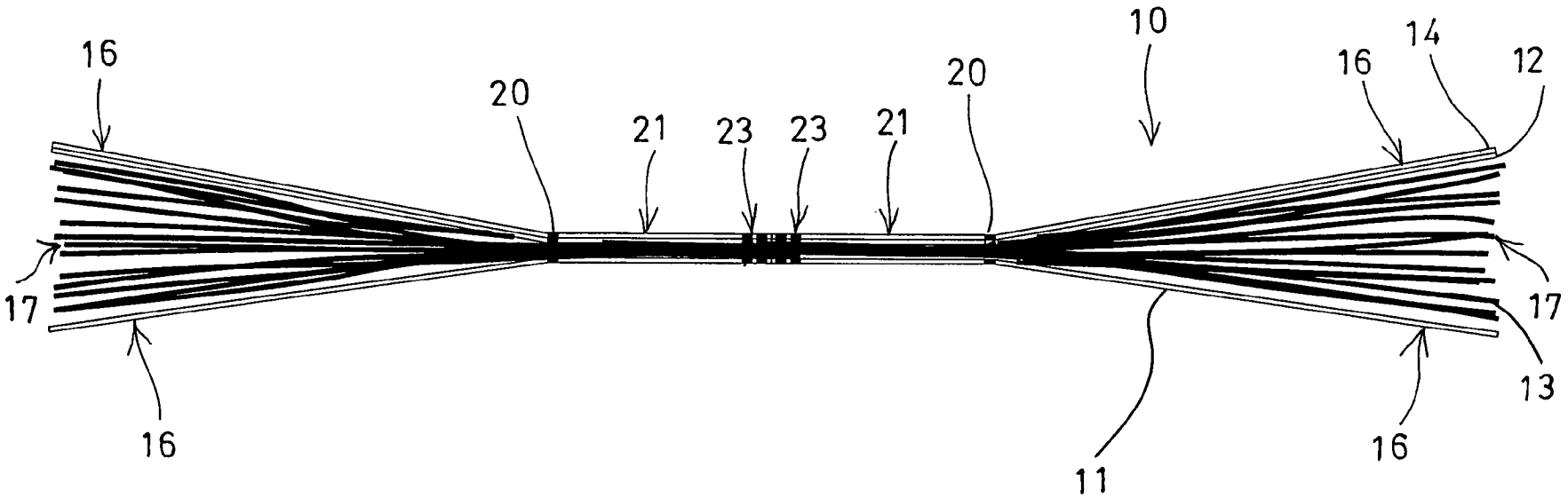
FIG. 5 is a cross sectional view taken along lines 5—5 of FIG. 3.

It is preferable that the outer fabric layer 14 includes a length smaller than that of the cover fabric layer 12 and/or the base fabric layer 11, for allowing the cover fabric layer 12 to be slightly extended outwardly beyond the outer fabric layer 14, best shown in FIGS. 1, 3, 6, in order to form an opening 22 in one side or one end of the pockets 21, and thus for allowing the handle 30 to be easily engaged into the pockets 21 (FIGS. 1, 6).

The outer fabric layer 14 may further be secured to the cover fabric layer 12 and/or the base fabric layer 11 with one or more, such as two further longitudinal and parallel welding lines or portions 23 that may be formed in the middle portions of the fabric layers 11, 12, 14, and located between the welding portions 20. A further welding portion 24 may be provided on one side or one end of the fabric layers 11, 12, 14, to form two pockets 21 each having three closed sides 20, 23, 24 and an opening side 22.

A cut line 25 may be partially formed or provided between the pockets 21, particularly between the welding portions 23, but not fully formed between the pockets 21, to allow the pockets 21 to have only one side or one end to be separated from each other (FIGS. 1, 6). One or more stitches or fibers 27 may further be provided to breakably couple the pockets 21 or the welding portions 23 together, and may be broken when the handle 30 is engaged into the pockets 21, for example.

Each of the base and the cover and the outer fabric layers 11, 12, 14 includes a number of lateral fabric strips 15 formed or provided in one or both side portions 16 thereof, for allowing the side portions 17 of the fibers 13 to be partially exposed, and thus for facilitating cleansing operation of the cleansing cloth 10.

Referring next to FIGS. 6–10, the handle 30 includes a fork 31 having two arms 32 for engaging into the pockets 21 respectively (FIG. 6), and one or more projections 33 extended from the arms 32, for engaging with the pockets 21, and for increasing a frictional force or a retaining force to stably attach and retain the cloth 10 to the handle 30.

Figure 8:
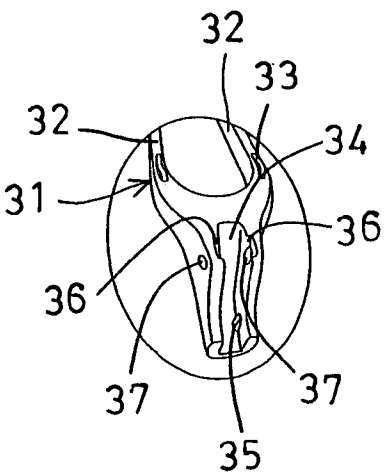
FIG. 8 is an enlarged partial perspective view of the handle of the cleansing device.
Figure 10:
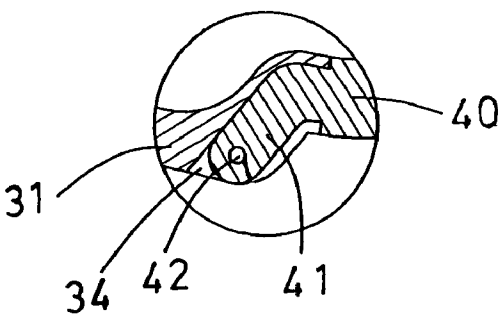
FIG. 10 is a cross sectional view taken along lines 10—10 of FIG. 9.

As shown in FIG. 8, the fork 31 includes a chamber 34 formed therein, and includes one or more catches 35 extended into the chamber 34 thereof, and includes one or more, such as two grooves 36 formed therein and communicating with the chamber 34 thereof, and includes an orifice 37 laterally formed therein and communicating with the chamber 34 and the grooves 36 thereof.

Figure 11:
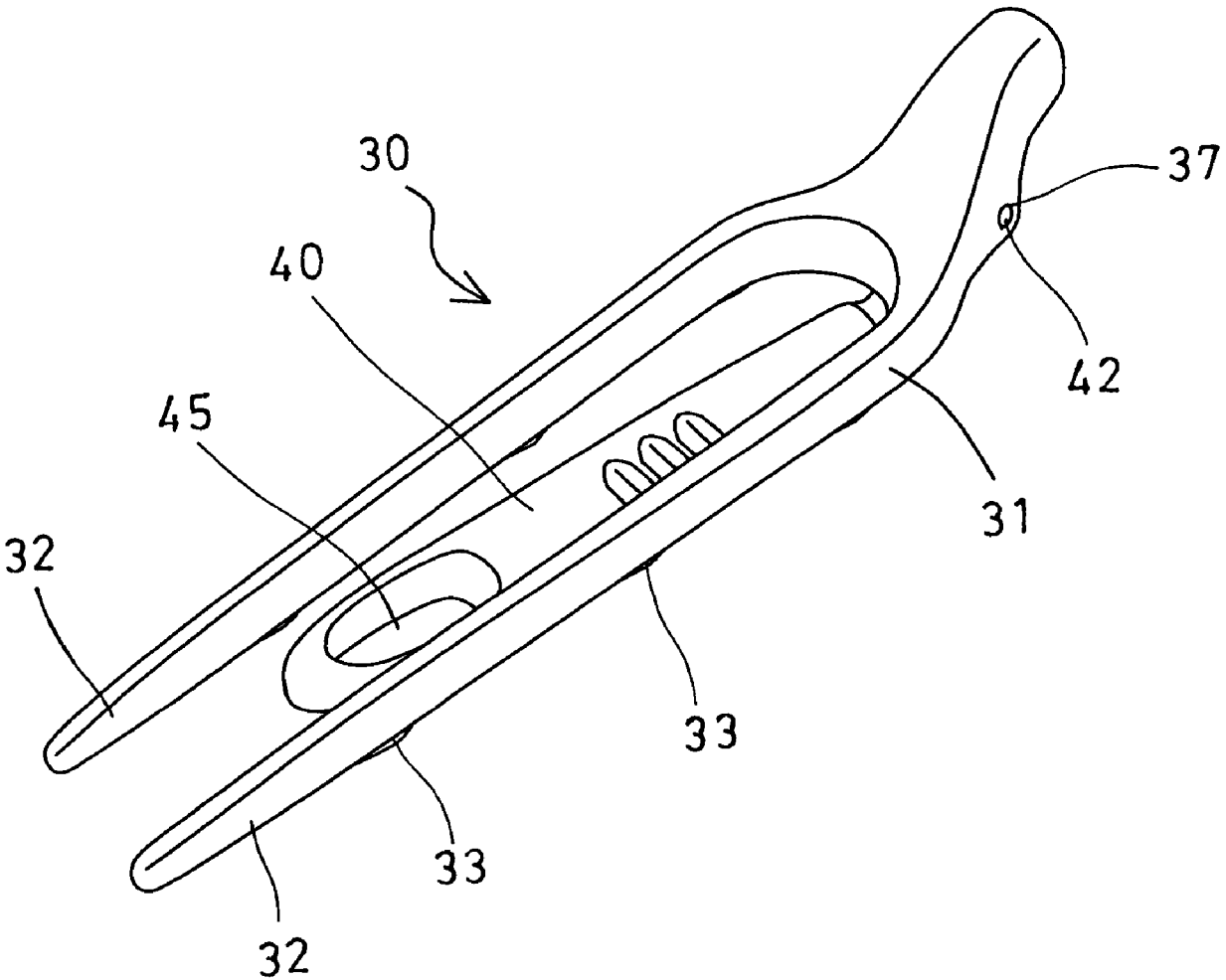
FIG. 11 is a perspective view illustrating the folding configuration of the handle of the cleansing device.

The handle 30 further includes a hand grip 40 having a shank 41 engageable into the chamber 34 of the fork 31. The hand grip 40 includes one or more, such as two pins 42 extended therefrom or extended from the shank 41, and engaged into the orifice 37 of the fork 31 via the grooves 36 of the fork 31, to rotatably or pivotally secure the hand grip 40 to the fork 31, and for allowing the hand grip 40 to be rotated relative to the fork 31 between an outwardly extending or working position (FIGS. 1, 6, 9) and an inwardly folding or storing position (FIG. 11).

Figure 9:
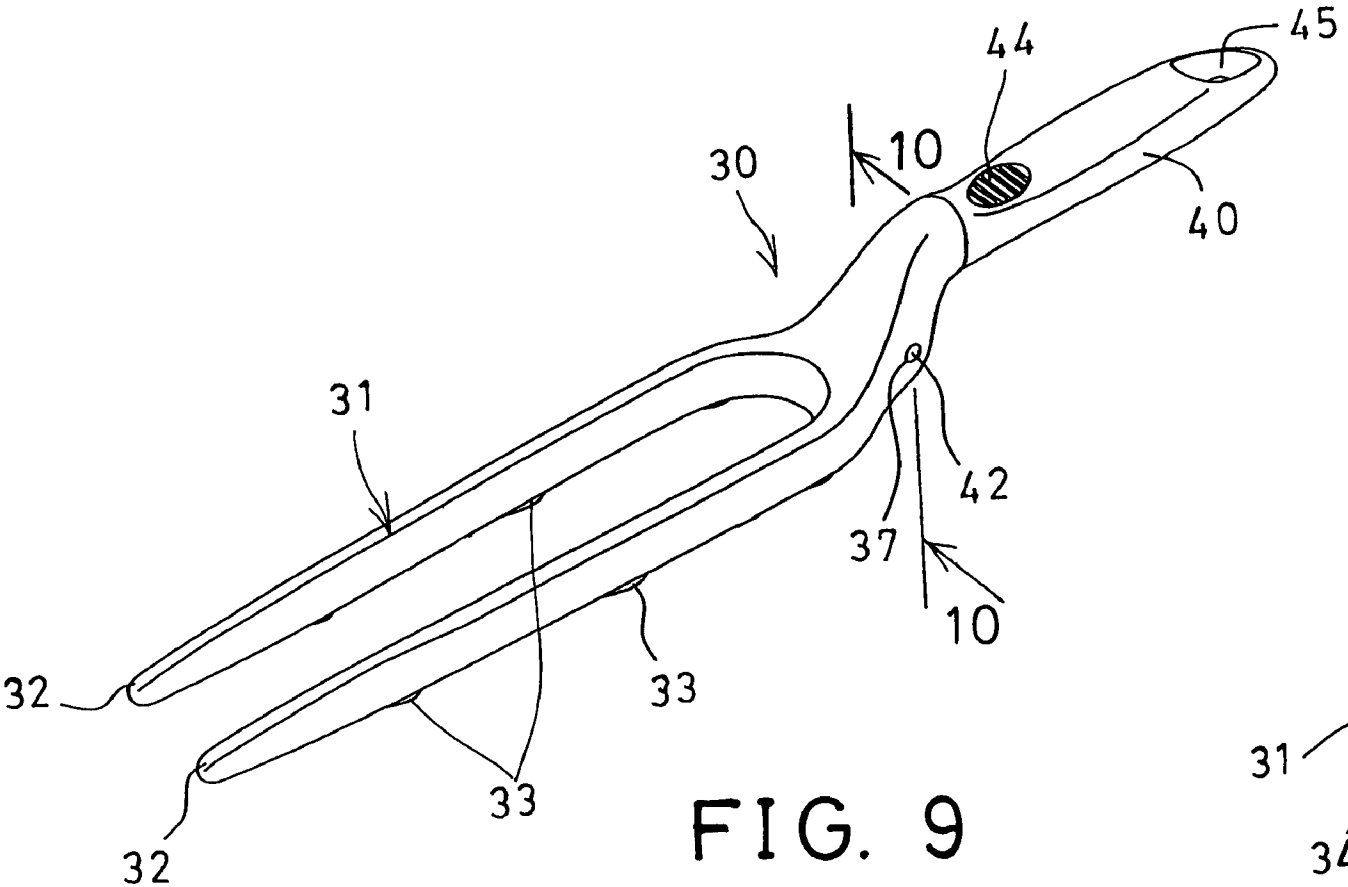
FIG. 9 is a perspective view of the handle.

The hand grip 40 includes one or more, such as two notches 43 formed in the shank 41 (FIG. 7), to receive the catches 35, and to releasably retain or secure the hand grip 40 to the fork 31 at the outwardly extending or working position (FIGS. 1, 6, 9). It is preferable that the hand grip 40 includes a knurled or soft portion 44 provided therein for facilitating holding or grasping of the hand grip 40 by users, and includes an aperture 45 formed therein for hanging or displaying purposes.

In operation, as shown in FIG. 6, the arms 32 of the fork 31 may be engaged into the pockets 21 of the cloth 10 via the openings 22 of the cloth 10. The stitches or fibers 27 of the cloth 10 may be arranged to be broken when the arms 32 of the fork 31 are engaged into the pockets 21 of the cloth 10, and/or when the arms 32 of the fork 31 include a separating distance greater than the distance between the welding portions 20 of the cloth 10, to allow the cloth 10 to be stably attached or secured to the fork 31 of the handle 30.

The engagement or the provision of the fibers 13 between the base and the cover fabric layers 11, 12 may facilitate the cleaning and wiping processes of the cleansing cloth 10. The attachment of the handle 30 to the cloth 10 allows the cloth 10 to be easily carried or held or operated with the handle 30.

Accordingly, the cleansing device in accordance with the present invention includes a number of fibers for cleansing purposes, and/or including a handle for easily holding and carrying the cleansing device, and preferably including a handle that may be folded to compact folding or storing configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cleaning device comprising:

a cleaning cloth including a base fabric layer, a cover fabric layer disposed above said base fabric layer, and a plurality of fibers disposed between and secured between said base and said cover fabric layers, and a handle attached to said cleaning cloth to carry and operate said cleaning cloth;

said base fabric layer includes at least one side having a plurality of strips formed therein to partially expose said fibers;

wherein said cover fabric layer includes at least one side having a plurality of strips formed therein to partially expose said fibers;

wherein an outer fabric layer attached onto said cover fabric layer, and secured said cover fabric layer to form at least one pocket and to receive said handle;

wherein said cleaning cloth includes two welding portions provided on said outer and said cover fabric layers, to secure said outer and said cover fabric layer together, and to form said at least one pocket in said cleaning cloth;

wherein said cleaning cloth includes one end having a welding portion provides thereon, to form a closed end for said at least one pocket; wherein said cover fabric layer includes a length greater than that of said outer fabric layer to facilitate an engagement of said handle into said at least one pocket of said cleaning cloth; wherein said handle includes a fork having two arms engageable into said at least one pocket of said cleaning cloth;

wherein said cleaning cloth includes two second welding portions provided on said outer and said cover fabric layers, and arranged between said welding portions to separate said at least one pocket into two pockets;

wherein said cleaning cloth includes at least one fiber coupled between said two cleaning pockets, to breakably couple said two pockets together;

wherein said cleaning cloth includes a cut portion partially formed between said second welding portions to allow said two pockets to be partially separated from each other;

and said two pockets are separated at a first end and are connected at a second end; said two pockets are open at said first end and closed at said second end; said two arms of said handle are inserted into said open first end of the said two pockets;

wherein said handle includes at least one projection extended from a lower side of each of said arms, for frictionally engaging with said cleaning cloth;

wherein said handle includes a handle grip pivotally attached to said fork, to allow said hand grip to be rotated relative to said fork between an outwardly extending position and an inwardly folding position;

wherein said cleaning means further comprises means for retaining said hand grip to said fork at said outwardly extending position;

wherein said retaining means includes at least one notch formed in said hand grip, and at least one catch extended form said fork and engageable into said at least one notch of said hand grip.

* * * * *